US006820584B2

(12) United States Patent
Koerner et al.

(10) Patent No.: US 6,820,584 B2
(45) Date of Patent: Nov. 23, 2004

(54) OIL PRESSURE MONITORING SYSTEM FOR TWO-STROKE ENGINES

(75) Inventors: Scott A. Koerner, Kenosha, WI (US); Anteo Opipari, Chicago, IL (US)

(73) Assignee: Bombardier Recreational Products Inc., Valcourt (CA)

( * ) Notice: Subject to any disclaimer, the term of this patent is extended or adjusted under 35 U.S.C. 154(b) by 8 days.

(21) Appl. No.: 10/349,944

(22) Filed: Jan. 22, 2003

(65) Prior Publication Data

US 2003/0216093 A1 Nov. 20, 2003

(Under 37 CFR 1.47)

Related U.S. Application Data

(60) Provisional application No. 60/319,092, filed on Jan. 22, 2002.

(51) Int. Cl.[7] ..... F01M 1/00; B63H 21/10

(52) U.S. Cl. ..... 123/196 R; 440/88 L

(58) Field of Search ..... 123/196 R, 196 M, 123/73 AD; 440/88 L

(56) References Cited

U.S. PATENT DOCUMENTS 6,626,141 B2 * 9/2003 Choi ..... 123/196 R

* cited by examiner

*Primary Examiner*—Noah P. Kamen
(74) *Attorney, Agent, or Firm*—BRP Legal Services

(57) ABSTRACT

The present invention provides a system and method to adjust the quantity of oil delivered to the cylinders of an internal combustion engine of an outboard motor. The system includes an oiling system to distribute oil throughout the internal combustion engine. The oiling system has a pressure sensor connected between an oil injector and the internal combustion engine to sense oil pressure and produce an oil pressure indicative signal to an electronic control unit (ECU). The ECU is configured to monitor the oil pressure indicative signal and modify a modulated oil injection signal delivered to the oil injector.

31 Claims, 3 Drawing Sheets

FIG. 1
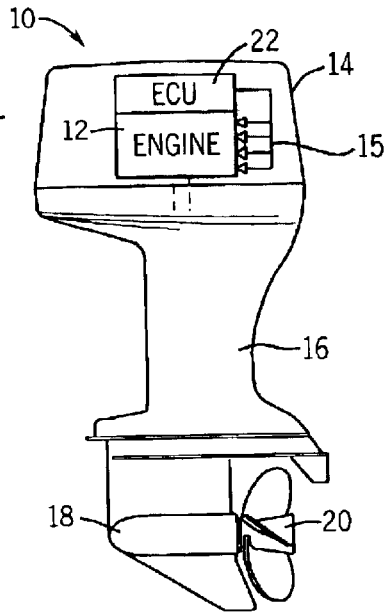
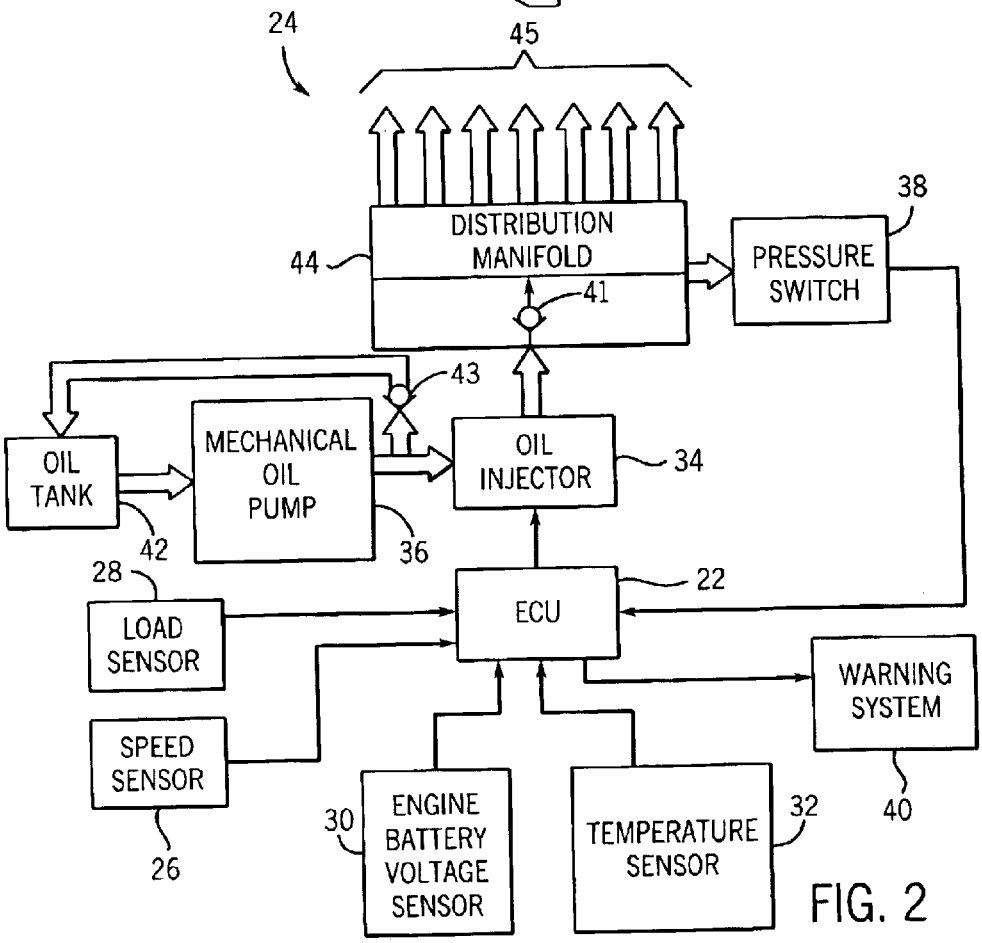
FIG. 2

OIL PRESSURE MONITORING SYSTEM FOR TWO-STROKE ENGINES

CROSS REFERENCE TO RELATED APPLICATION

The present claims the benefit of U.S. Ser. No. 60/319,092 filed Jan. 22, 2002.

BACKGROUND OF THE INVENTION

The present invention relates generally to a low oil warning system, and more particularly, to an apparatus and method to monitor oil pressure and other engine parameters in a two-stroke fuel injected engine.

Typically, two-stroke outboard marine engines do not have a separate oiling system. That is, these prior art engines require pre-mixing lubricant and fuel so that the lubricant dissolves in the fuel to lubricate the engine. This requires consistent, accurate measuring and agitation of the mixture. There are many disadvantages to the prior art system of pre-mixing lubricant and fuel. For example, since various two-stroke engines require different mix concentrations, and many outboard marine engine owners also own other two-stroke engine equipment, such as various lawn and garden equipment, snowmobiles, and ATVs, they may need to store several different concentrations of oil/fuel mixtures. This is not only an aggravation to the owner, but is also problematic if the containers become mixed up and the owner uses the wrong concentration for a particular two-stroke engine. While this is not catastrophic, if run over time with the wrong concentration, a two-stroke engine can wear excessively.

The present invention is for use in a unique lubrication system for two-stroke engines. Such a lubrication system must provide lubrication to each cylinder of the engine and provide lubrication to the fuel system to properly lubricate the fuel metering and injection system from an oil reservoir.

Unlike four-stroke engines, which are designed to re-circulate oil for lubrication and not consume oil, a two-stroke engine, by its nature, consumes oil during use. An oil injection system for a two-stroke engine is typically designed to pump just enough oil as is needed for lubrication and then it is consumed. Without feedback however, problems can occur in such metering systems. For example, engine temperature and ambient temperature can affect lubricant viscosity resulting in a need to change the rate of oil delivery. Also, certain operating conditions require more or less oil. Therefore, it would be advantageous to have an oil pressure monitoring system that continuously monitors oil pressure and consistently maintains a sufficient oil supply to the two-stroke engine. It would also be advantageous if the oil pressure monitoring system regulated the engine to reduce engine damage if sufficient oil cannot be supplied to the engine.

BRIEF DESCRIPTION OF THE INVENTION

The present invention provides an oil delivery system for a fuel injected engine that continuously monitors oil pressure and attempts to consistently maintain an oil supply to the two-stroke engine by adjusting a duty cycle of an oil injection solenoid solving the aforementioned concerns.

The present invention provides a system and method to regulate the amount of oil delivered to the cylinders of the two-stroke internal combustion engine. The invention includes an oiling system for distributing oil throughout the internal combustion engine. The oiling system includes a pressure sensor connected between an oil injector and the internal combustion engine, which senses oil pressure and produces an oil pressure indicative signal to an electronic control unit (ECU). The ECU receives and monitors the oil pressure indicative signal and is configured to modify an oil injection signal delivered by the ECU to the oil injector.

In accordance with one aspect of the invention, an oil monitoring system for a two-stroke engine is provided. The system includes an oil system having an oil inlet, an oil outlet, and an electronic oil injector therebetween. The system also includes a pressure sensor connected to the oil system downstream of the electronic oil injector that is configured to detect oil pressure in the two-stroke engine. An ECU is also provided, wherein the ECU is in communication with the pressure sensor, the electronic oil injector, and an optional low oil warning system. The ECU is programmed to modify a duty cycle of the electronic oil injector upon the ECU receiving an oil pressure indicative signal indicating low oil pressure from the pressure sensor. If a desired oil pressure cannot be obtained, the ECU is further programmed to limit engine operation and activate the warning system so as to prevent a catastrophic engine failure, but allow the operator to use their judgment in operating the engine to travel to a safe harbor.

In accordance with one aspect of the present invention, an outboard motor is disclosed that includes an internal combustion engine having an oiling system to distribute oil throughout the internal combustion engine. The outboard motor also includes a water propulsion unit in operable association with the internal combustion engine to propel the outboard motor. The engine includes at least one oil injector connected to the oiling system to cause oil delivery through the oiling system. A pressure sensor is connected to the oiling system between the at least one oil injector and the engine to sense oil pressure downstream of the at least one oil injector and produce an oil pressure indicative signal in response thereto. The outboard motor also has an ECU connected to deliver a modulated signal to the at least one oil injector. The ECU is also connected to the pressure sensor to receive the oil pressure indicative signal. The ECU is configured to monitor the oil pressure indicative signal and modify the modulated signal in response thereto to regulate oil delivery through the internal combustion engine.

In accordance with another aspect of the present invention, a method of detecting a low oil pressure condition in a two-stroke engine includes the step of detecting oil pressure in a two-stroke fuel injected engine and determining if the detected oil pressure is within a given range for a given set of engine operating parameters, and if not, modifying a duty cycle of oil injection into the two-stroke engine. The method also includes the step of monitoring the duty cycle of oil injection and comparing the modified duty cycle to a range of duty cycle limits. The method also includes the step of limiting engine operation if the modified duty cycle is outside the range of duty cycle limits, and if not, repeating the aforementioned steps.

In accordance with yet another aspect of the present invention, an oil monitoring system for a two-stroke engine includes a means for injecting oil into a two-stroke engine, and a means for determining if the detected oil pressure is within a given range for a given set of engine parameters. Additionally, the oil monitoring system has a means for modifying the oil injected into the two-stroke engine to maintain the oil pressure within the range for the given set of engine parameters and if the oil pressure cannot be so adjusted, limiting engine operation.

Various other features, objects and advantages of the present invention will be made apparent from the following detailed description and the drawings.

BRIEF DESCRIPTION OF THE DRAWINGS

The drawings illustrate one embodiment presently contemplated for carrying out the invention.

In the drawings:

FIG. 1 is a side elevational view of an outboard marine engine having a schematic representation of a two-stroke engine constructed in accordance with a preferred embodiment of the present invention.

FIG. 2 is a block diagram of a control and oiling system of the two-stroke engine of FIG. 1.

DETAILED DESCRIPTION OF THE PREFERRED EMBODIMENT

Figure 3:
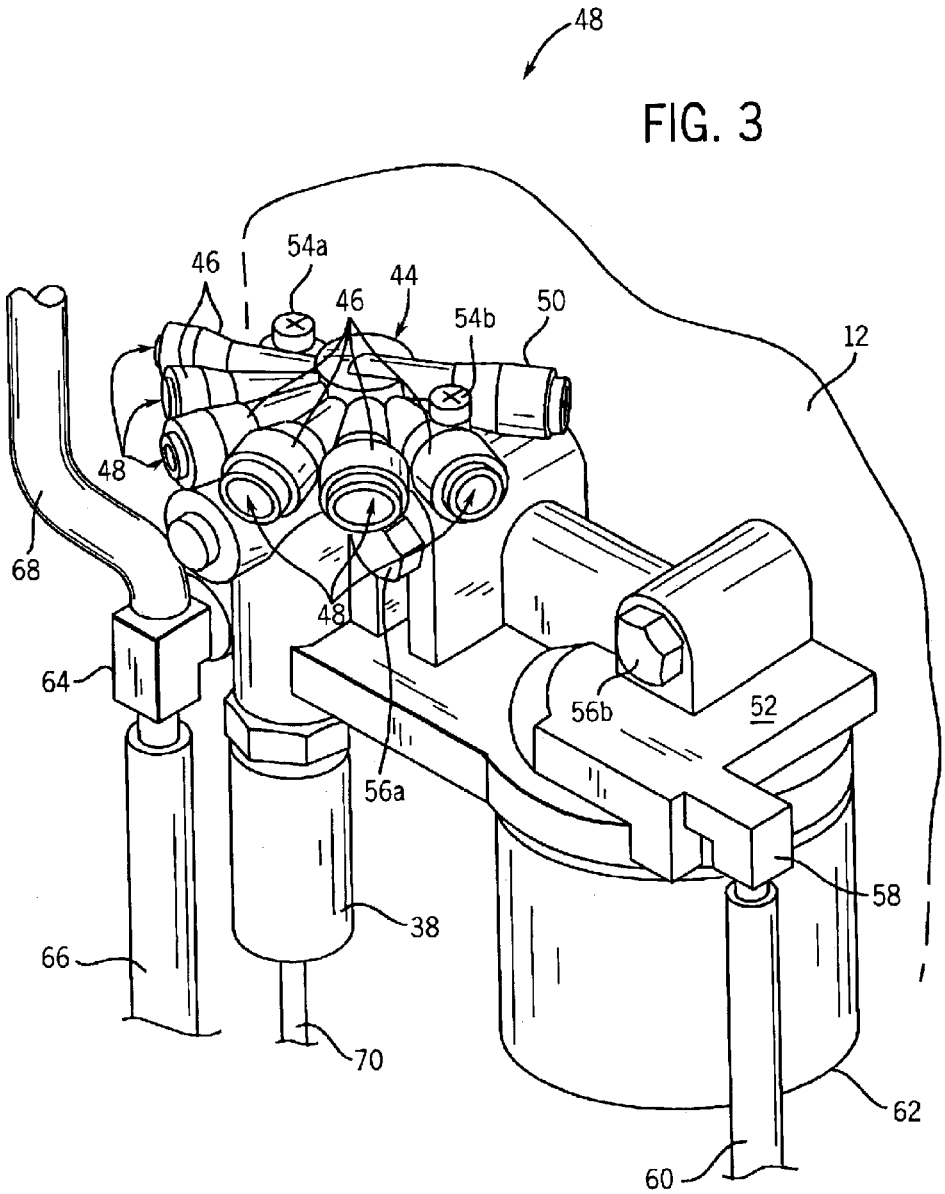
FIG. 3 is a perspective view of one embodiment of an oiling system for a two-stroke outboard marine engine.

The present invention is applicable to virtually any two-stroke engine, but is ideally situated for application in fuel injected two-stroke engines, such as those used in snowmobiles, personal watercraft, and lawn and garden equipment. One such engine is illustrated in FIG. 1. An outboard motor 10 includes a two-stroke internal combustion engine 12. The engine 12 is housed in a powerhead 14 connected to a water propulsion unit. The water propulsion unit includes a midsection 16 and a lower gear case 18. The powerhead 14 is supported on the mid-section 16 configured for mounting on the transom of a boat (not shown) in a conventional manner. The output shaft of the engine 12 is coupled to a drive unit in the midsection 16. Power is transferred to a propeller 20 extending rearwardly of the lower gearcase 18 to propel the outboard motor 10. The engine 12 is controlled by an integral computer or electronic control unit (ECU) 22. In the illustrated embodiment, the engine 12 is preferably equipped with electric start as well as electronic fuel injection and electronic ignition generally referenced as 15. However, it should be understood that the invention is equally applicable to a variety of other two-stroke engines.

It is well known in the art that engine torque, engine speed, engine emissions, and engine temperature can be optimized by adjusting the amount of fuel, air, and oil supplied to the cylinders and the time at which the fuel is ignited. Fuel and oil injection systems are ideal for controlling these parameters. The present invention utilizes these systems and maximizes their use. In the present invention, the amount of oil injected into each engine cylinder is controlled by a modulated signal or pulse applied to an oil injector to hold it open for a predetermined period of time, thus allowing only a particular quantity of oil to be injected into each cylinder. The modulated signal can be pulse width modulated, or alternatively, frequency modulated to provide the predetermined amount of oil. Adjusting the width or frequency of the modulated signal, or duty cycle of an oil injector, permits increasing or decreasing of the quantity of oil delivered to each of the engine cylinders and can reduce the occurrence of low oil pressure conditions during engine operation.

Referring now to FIG. 2, a block diagram is shown of an oil distribution system 24 having the central ECU 22 of FIG. 1 which receives inputs such as engine speed or revolutions per minute (RPM) from RPM sensor 26, engine load from sensor 28, engine battery voltage from sensor 30, and engine and/or ambient temperature from sensor 32. It will also be appreciated, that one of the primary purposes of the ECU 22 in an engine application is to control the ignition firing and timing of an ignition circuit 15, FIG. 1. Further, the ECU 22 can be configured to detect a fault condition and if the fault condition is detected, cause the internal combustion engine 12 to operate in a "limp home" mode to prevent damage to the internal combustion engine 24 until a reset condition occurs. Such a mode of operation is provided to allow an operator to use their discretion in operating the motor and allow the operator to reach a safe harbor. The ECU 22 also controls the firing of each engine cylinder, and provides a modulated signal to an oil injector 34. Thus, each cylinder of the internal combustion engine 12 receives an ignition firing signal from the ECU 22. The ECU may also control a lift pump, or the lift pump may be a mechanical oil pump 36 to supply oil to the oil injector 34.

The ECU is also connected to a pressure sensor, or pressure switch 38, which can be mounted to an oil distribution manifold 44 to sense oil pressure downstream of the oil injector 34. The oil distribution manifold 44 includes a check valve 41 to prevent backflow of oil and require a pressure surge of oil from the oil injector 34 to send oil through the oil distribution manifold 44. The ECU receives oil pressure indicative signals from the pressure sensor 38 to detect oil pressure, such as a low oil pressure condition. For each signal, the ECU 22 monitors the oil pressure indicative signal and determines therefrom if the oil injector 34 is delivering oil properly. Once a low oil pressure condition is detected, the ECU 22 can transmit a fault signal to a warning system 40 to indicate the occurrence of a low oil pressure condition, for example. The warning system 40 is preferably configured to at least notify an operator and/or technician of the low oil pressure condition indicating oil flow through the distribution manifold 44 is malfunctioning. In alternative embodiments, the warning system 40 can include indicator LEDs, gauges, bells, or other components configured to warn of other fault conditions, such as the engine speed exceeding an RPM limit. Examples of other fault conditions that can be indicated by the warning system 40 can include excess load on the engine 12, low battery voltage, or high engine temperature.

The oil injector 34, mechanical oil pump 36, and pressure switch 38 are part of an oiling system of engine 12 which further includes check valves 41, 43 and an oil supply tank 42. Generally, the check valves are designed to prevent a reverse flow of oil. However, check valve 41 also sets a minimum pressure for oil flow that the oil injector must overcome when activated. Additionally, the oiling system of engine 12 includes distribution manifold 44, and a series of oil distribution lines 45 connecting the distribution manifold 44 to each cylinder of the engine and preferably to the fuel system to mix a small amount of oil with the fuel for oiling the fuel injection system.

In operation, oil is drawn from oil tank 42 by mechanical oil pump 36. A return path is provided through check valve 43 to return unused oil to oil tank 42. The ECU 22 provides a control signal to an oil injector 34, which preferably includes a solenoid. Oil received by the oil injector 34 is injected into the distribution manifold 44 after passing through check valve 41, where it is distributed along lines 45 to the engine 12. A pressure switch 38 is housed in the distribution manifold 44 to measure oil pressure in the distribution manifold 44 upstream of oil injector 34. In response to measuring the oil pressure, the oil pressure switch or sensor creates an oil pressure indicative signal sensed by ECU 22 indicating oil pressure within the oiling system as oil is injected into the distribution manifold 44.

As will be described in more detail with reference to FIG. 4, if low oil pressure is detected, ECU 22 transmits a signal to the oil injector 34 to inject oil into the system. If the system fails to deliver oil, then the ECU can cause the internal combustion engine 12 to run in a restricted mode of operation until a reset occurs. Upon occurrence of the reset, the ECU 22 preferably transmits a pulse modulated signal to the oil injector 34 to permit the internal combustion engine 12 to run in an unrestricted mode of operation. Equivalently, the ECU can also generate a frequency modulated signal. Preferably, the ECU 22 is connected to a fuel injector system 15, FIG. 1, that can be controlled by the ECU to enable the ECU to cause the internal combustion engine 12 to operate in either the restricted or unrestricted mode.

FIG. 3 provides one exemplary oiling system 48 for the present invention that connects to the oil injector to distribute oil throughout the internal combustion engine. Preferably, the oiling system 48 shown in FIG. 3 is connected between the oil injector 34 and the internal combustion engine 12 of FIGS. 1 and 2. Pressure sensor 38 is connected to sense oil pressure downstream of the oil injector 34 and produce an oil pressure indicative signal in response thereto. The oil pressure switch 38 communicates with ECU 22 through wire 70. The oiling system 48 includes check valve 41 of FIG. 2 located in the distribution manifold 44 to prevent oil flow until the oil injector is supplied with a modulation signal from the ECU. The distribution manifold 44 has a plurality of cylinder outlet housings 46 for each cylinder of a two-stroke internal combustion engine. In this embodiment, distribution manifold 44 has six outlets 48, one for each cylinder of a six cylinder engine and one fuel system oiling outlet housing 50. The manifold 44 is mounted to an oil system housing 52 with mounting bolts 54*a*, 54*b*. The oil system housing 52 is mounted to the engine 12 with mounting bolts 56*a*, 56*b*. In this particular arrangement, oil is introduced into the oil system housing 52 in oil inlet 58 through oil supply line 60. Optionally, oil can be internally routed to a replaceable oil filter 62. The oil system housing 52 can also include a solenoid (not shown) to control the flow of oil from the oil filter 62 to either the distribution manifold 44, or an oil outlet 64. The solenoid is controlled by power supplied from the ECU 22 of FIGS. 1 and 2. The oil outlet 64 includes a return line 66 and a vent line 68.

Figure 4:
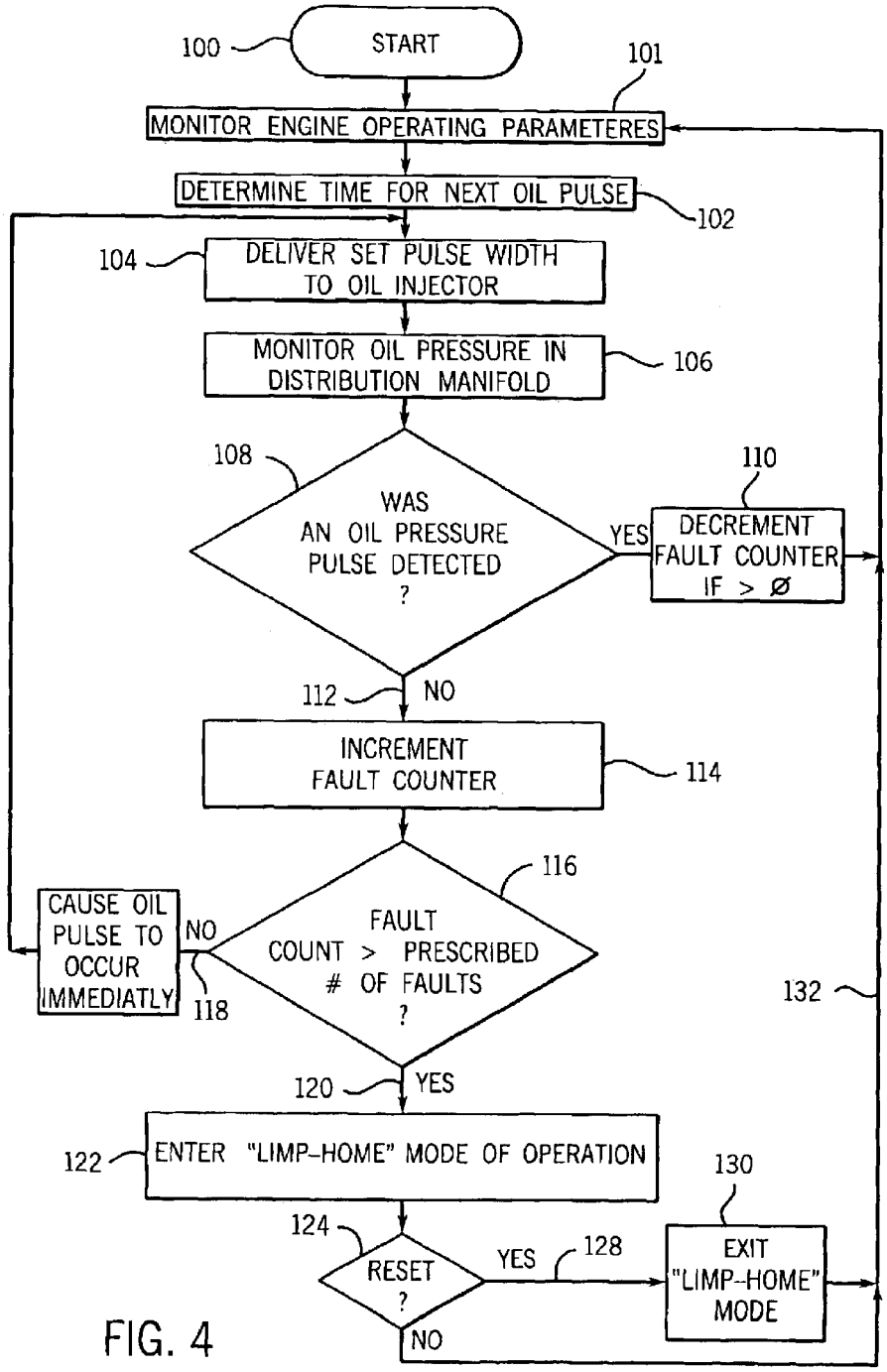
FIG. 4 is a flow chart showing an implementation of the present invention for use with the apparatus of FIGS. 1–3.

Referring now to FIG. 4, the method steps of the present invention, together with the acts accomplished by the instructions of the computer program, are depicted in flow chart form. Upon initialization 100, the engine is monitored to determine instantaneous operating parameters 101. These operational parameters may include engine and ambient temperatures, engine speed or RPM, battery voltage, and/or load on the engine. By determining parameters of operation, a time for next oil pulse can be ascertained at 102. A predetermined modulation signal is delivered to an oil injector at 104. As previously discussed, and as will become apparent, the modulation signal may be modulated by any method, including modulating its frequency or pulse width and is designed to temporarily adjust the duty cycle of the oil injector. The signal transmitted to the oil injector by the ECU determines the quantity of oil delivered to the engine cylinders. After step 104-2, the program proceeds to monitor the oil pressure in the distribution manifold 106 to determine if the oil pressure is within a given range for a given set of engine parameters.

After monitoring oil pressure in the distribution manifold 106, a query determines if an oil pressure pulse occurred to input oil into the engine 108. If so, the program branches and at 110 decrements a fault counter if the counter has a value greater than zero. As will be described below, a prescribed number of faults are permitted. Therefore, the fault counter is decremented at step 110 so that the number of accrued faults relative to the number of faults allowed can be monitored and the program then returns to step 101 to again monitor engine operating parameters. However, if an oil pressure pulse was not detected 108, 112, the program increments the fault counter by one 114. To insure proper long-term operation of the engine, only a prescribed number of "faults" will be permitted. A "fault" is recognized as a failure of an oil pressure pulse to occur after such a pulse has been prescribed at step 104. Next, the program determines if the fault counter has a value that exceeds the number of prescribed faults.

If the number of faults does not exceed the allowable number 116, the program causes an oil pulse to occur immediately such that oil is delivered to the distribution manifold. The program then loops back to step 104 and delivers the predetermined modulation signal to the oil injector. On the other hand, if it is determined that the number of faults exceed the prescribed number 116, 120 the program and/or method causes the engine to enter a "limp-home" or restricted mode of operation 122. In this mode, the ECU limits the engine's RPM to protect the engine. In a fuel injected engine, the ECU can limit engine speed by controlling the fuel injectors. In a carbureted engine, an electronic governor can be used. A warning signal can be generated by the ECU at step 122 and transmitted to a warning system to indicate low oil pressure on an indicator light.

After entering the "limp-home" mode of operation, the program determines whether to reset the pulse width 124 delivered to the oil injector. Reset can occur by power down of the system, or alternatively, manually by operator or service personnel intervention. If a reset is not selected 126, the system loops back to step 101 and continues to monitor engine operating parameters. If the problem does not self-correct, the engine will remain in the restricted mode of operation until a reset is received by the ECU or the problem corrects itself. If a reset is selected 124, 128, the pulse width is reset 130, and the system exits the "limp-home" mode 130 and thereafter loops back 132 to step 101 to monitor engine parameters. Alternatively, frequency modulation of the pulse can occur prior to the looping back 132 to step 101.

In accordance with one embodiment of the invention, an oil monitoring system for a two-stroke engine is provided. The system includes an oil system having an oil inlet, an oil outlet, and an electronic oil injector therebetween. The system also includes a pressure sensor connected to the oil system downstream of the electronic oil injector that is configured to detect oil pressure in the two-stroke engine. An ECU is also provided, wherein the ECU is in communication with the pressure sensor, the electronic oil injector, and an optional low oil warning system. The ECU is programmed to modify a duty cycle of the electronic oil injector upon the ECU receiving an oil pressure indicative signal indicating low oil pressure from the pressure sensor. If a desired oil pressure cannot be obtained, the ECU is further programmed to limit engine operation and activate the warning system so as to prevent a catastrophic engine failure, but allow the operator to use their judgment in operating the engine to travel to a safe harbor.

In accordance with one embodiment of the present invention, an outboard motor is disclosed that includes an internal combustion engine having an oiling system to distribute oil throughout the internal combustion engine. The outboard motor also includes a water propulsion unit in operable association with the internal combustion engine to propel the outboard motor. The engine has at least one oil injector connected to the oiling system to cause oil delivery through the oiling system. A pressure sensor is connected to the oiling system between the at least one oil injector and the engine to sense oil pressure downstream of the at least one oil injector and produce an oil pressure indicative signal in response thereto. The outboard motor also has an ECU connected to deliver a modulated signal to the at least one oil injector. The ECU is also connected to the pressure sensor to receive the oil pressure indicative signal. The ECU is configured to monitor the oil pressure indicative signal and modify the modulated signal in response thereto to regulate oil delivery through the internal combustion engine.

In accordance with another embodiment of the present invention, a method of detecting a low oil pressure condition in a two-stroke engine includes the steps of (A) detecting oil pressure in a two-stroke fuel injected engine and (B) determining if the detected oil pressure is within a given range for a given set of engine parameters, and if not, modifying a duty cycle of oil injection into the two-stroke engine. The method also includes the step (C) of monitoring the duty cycle of oil injection and comparing the modified duty cycle to a range of duty cycle limits. Further, the method includes the step (D) of limiting engine operation if the modified duty cycle is outside the range of duty cycle limits, and if not, repeating steps (A)–(C).

In accordance with yet another embodiment of the present invention, an oil monitoring system for a two-stroke engine includes a means for injecting oil into a two-stroke engine, and a means for determining if the detected oil pressure is within a given range for a given set of engine parameters. Additionally, the oil monitoring system has a means for modifying the oil injected into the two-stroke engine to maintain the oil pressure within the range for the given set of engine parameters and if the oil pressure cannot be so adjusted, limiting engine operation.

The present invention has been described in terms of the preferred embodiment, and it is recognized that equivalents, alternatives, and modifications, aside from those expressly stated, are possible and within the scope of the appending claims.

What is claimed is:

1. An oil monitoring system for a two-stroke engine comprising:

an oil system having an oil inlet, an oil outlet, and an electronic oil injector therebetween;

a pressure sensor connected to the oil system downstream of the electronic oil injector and configured to detect oil pressure in a two-stroke engine and generate an oil pressure indicative signal; and an ECU in communication with the pressure sensor and the electronic oil injector, wherein the ECU is programmed to modify a duty cycle of the electronic oil injector upon the ECU receiving an oil pressure indicative signal indicating low oil pressure from the pressure sensor.

2. The oil monitoring system of claim 1 further comprising:

a fuel injection system controlled by the ECU;

a low oil warning system connected to the ECU; and wherein the ECU is further programmed to activate the low oil warning system and limit fuel injected by the fuel injection system if a modified duty cycle of the electronic oil injector is not within a given range.

3. The oil monitoring system of claim 1 further comprising a distribution manifold in communication with the oil outlet of an oil system housing to distribute lubricant to each cylinder of the two-stroke engine.

4. The oil monitoring system of claim 3 wherein the ECU is further programmed to deliver a modulated signal to the oil injector to temporarily modify the duty cycle of the electronic oil injector.

5. The oil monitoring system of claim 4 wherein the ECU is further programmed to limit an RPM setting signal to limit the RPM of the two-stroke engine.

6. The oil monitoring system of claim 4 wherein the modulated signal is one of a pulse width modulated signal and a frequency modulated signal.

7. The outboard motor of claim 3 further including a check valve configured to prevent backflow in the two-stroke engine upon oil injection into the distribution manifold.

8. The oil monitoring system of claim 1 wherein the ECU is further programmed to monitor at least one of a load, speed, engine battery voltage, engine temperature, and ambient temperature.

9. The oil monitoring system of claim 1 further comprising a remotely located oil reservoir and an oil pump to pump lubricant to the oil inlet.

10. An outboard motor comprising:

an internal combustion engine having an oiling system to distribute oil throughout the internal combustion engine;

a water propulsion unit in operable association with the internal combustion engine to propel the outboard motor;

at least one oil injector connected to the oiling system to cause oil delivery through the oiling system;

a pressure sensor connected to the oiling system between the at least one oil injector and the internal combustion engine to sense oil pressure downstream of the at least one oil injector and produce an oil pressure indicative signal in response thereto; and an electronic control unit (ECU) connected to deliver a modulated signal to the at least one oil injector and connected to the pressure sensor to receive the oil pressure indicative signal, the ECU configured to monitor the oil pressure indicative signal and modify the modulated signal in response thereto to regulate oil delivery through the internal combustion engine.

11. The outboard motor of claim 10 further comprising a check valve in the oiling system to prevent oil flow until the at least one oil injector is supplied with one of a pulse width modulated signal and a frequency modulated signal from the ECU.

12. The outboard motor of claim 11 further comprising a distribution manifold in communication with an oil outlet of an oil system housing to distribute lubricant to one or more cylinders of the internal combustion engine, and having the check valve therein.

13. The outboard motor of claim 12 wherein the pressure sensor is mounted to the distribution manifold to sense oil pressure downstream of the check valve.

14. The outboard motor of claim 10 wherein the ECU is further configured to identify a fault condition in response to the oil pressure indicative signal and if the fault condition is identified, limit operation of the internal combustion engine.

15. The outboard motor of claim 14 wherein the ECU limits engine operations by causing the engine to operate in a limp home mode to prevent damage to the internal combustion engine until a reset condition occurs.

16. The outboard motor of claim 15 wherein if the internal combustion engine enters the limp home mode, the ECU limits maximum RPM of the internal combustion engine and the ECU transmits a fault signal to a warning system indicative of the fault condition.

17. The outboard motor of claim 10 further comprising a warning system configured to receive a low oil pressure signal from the ECU indicating a low oil pressure condition.

18. The outboard motor of claim 10 wherein the ECU transmits one of a preset modulation signal to regulate oil delivery.

19. The outboard motor of claim 10 wherein the internal combustion engine is a direct fuel injected two-stroke engine.

20. A method of detecting a low oil pressure condition in a two-stroke engine, the method comprising the steps of:

(A) detecting oil pressure in a two-stroke fuel injected engine;

(B) determining if the detected oil pressure is within a given range for a given set of engine parameters, and if not;

(C) causing oil to be delivered into the two-stroke engine with a prescribed pulse width;

(D) determining if the oil was delivered and, if not, determining if a number of faults exceed a prescribed value; and (E) if the number of faults exceed the prescribed value, limiting engine operation, and if not, repeating steps (C)–(D).

21. The method of claim 20 wherein the given set of engine parameters includes at least one of battery voltage, engine temperature, ambient temperature, engine speed, and engine load.

22. The method of claim 20 further comprising the step of generating a warning signal upon a determination that the oil pressure is not within a given range.

23. The method of claim 20 further comprising the step of generating one of a pulse width modulated signal and a frequency modulated signal to cause oil injection into the two-stroke engine.

24. The method of claim 23 wherein the step of causing oil to be delivered further includes the step of transmitting the one of a pulse width modulated signal and a frequency modulated signal to an oil injector.

25. The method of claim 20 further comprising the step of detecting if a fault condition exists, and if so, restricting RPM of the two-stroke engine until the occurrence of a reset condition.

26. An oil monitoring system for a two-stroke engine comprising:

means for injecting oil into a two-stroke engine;

means for detecting if an oil pressure is within a given range for a given set of engine parameters; and means for modifying the oil injected into the two-stroke engine to maintain the oil pressure within the range for the given set of engine parameters and if the oil pressure cannot be adjusted further, limiting engine operation.

27. The oil monitoring system of claim 26 further including a means for directly injecting fuel into the two-stroke engine.

28. The oil monitoring system of claim 26 further including a means for generating a warning if the oil pressure cannot be brought within the range for the given set of engine parameters.

29. The oil monitoring system of claim 28 wherein the means for generating a warning includes at least an indicator light configured to activate upon receipt of a low pressure indicative signal from an ECU.

30. The oil monitoring system of claim 29 wherein the low pressure indicative signal is generated in response to an oil pressure sensor sensing a low oil pressure in an oil injection system.

31. The oil monitoring system of claim 26 wherein the means for modifying the oil injected into the two-stroke engine includes an oil injector coupled to an ECU, the ECU configured to transmit a modulated signal to cause the oil injector to deliver oil to the two-stroke engine.

* * * * *